United States Patent [19]

Decaux

[11] 4,301,558

[45] Nov. 24, 1981

[54] SANITARY UNIT

[76] Inventor: Jean C. Decaux, 53 avenue du Maréchal Lyautey, 75016 Paris, France

[21] Appl. No.: 160,486

[22] Filed: Jun. 18, 1980

Related U.S. Application Data

[63] Continuation-in-part of Ser. No. 964,454, Nov. 29, 1978, Pat. No. 4,210,973.

[30] Foreign Application Priority Data

Dec. 14, 1979 [FR] France ..... 79 30676

[51] Int. Cl.[3] ..... E03D 11/00

[52] U.S. Cl. ..... 4/420; 4/300; 4/111.2; 4/662; 4/DIG. 2

[58] Field of Search ..... 4/420, 420.3, 300, 312, 4/341, 661, 479, 662, DIG. 2, DIG. 3, 111.1, 111.2, 111.3

[56] References Cited

U.S. PATENT DOCUMENTS

| | | | |
|---|---|---|---|
| 2,075,830 | 4/1937 | Salvoni | 4/420.3 |
| 2,834,026 | 5/1958 | Kronish | 4/341 |
| 3,624,843 | 12/1971 | Andrus | 4/111.2 |
| 3,683,425 | 8/1972 | Patterson | 4/111.2 |
| 3,837,012 | 9/1974 | Rassbach et al. | 4/111.2 |
| 3,919,726 | 11/1975 | Godwin et al. | 4/420 |
| 4,148,103 | 4/1979 | Nishioka | 4/111.1 |

*Primary Examiner*—Henry K. Artis
*Attorney, Agent, or Firm*—Kenyon & Kenyon

[57] ABSTRACT

The unit is of the type comprising a vessel which is mounted to be movable between a position of use and a cleaning position. Cleaning means are actuated when the vessel is in its second cleaning position. Programming means co-ordinate the action of means for displacing the vessel and means for actuating the cleaning means in the course of each cycle of operation of the sanitary unit.

The programming means comprise detectors for producing signals each of which represents a given situation of the sanitary unit, memory means connected for storing said signals, and relay means connected to the memory means for exciting the control and actuating means.

16 Claims, 9 Drawing Figures

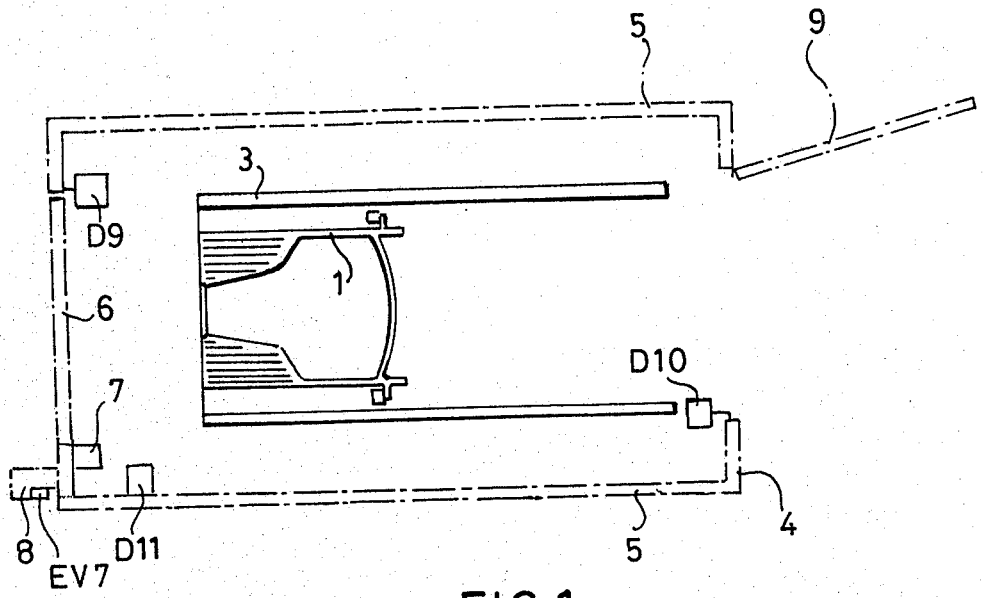
FIG.1
FIG.2
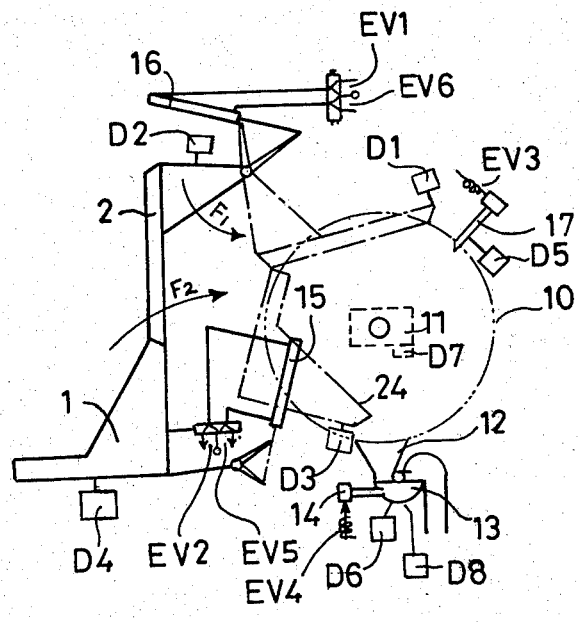

SANITARY UNIT

This is a continuation-in-part of application Ser. No. 964,454 filed Nov. 29, 1978, now U.S. Pat. No. 4,210,973.

Application Ser. No. 964,454 describes a sanitary unit comprising a vessel which is mounted to be movable between a first position of use and a second position for cleaning, cleaning means being brought into action when the vessel is in the second position, a pipe for discharging dirty water and dejections, means for controlling the displacement of the vessel, means for actuating the cleaning means and programming means for co-ordinating the action of said control means and said actuating means in the course of each cycle of operation of the sanitary unit, said programming means being associated with initiating means which initiates one cleaning cycle.

In application Ser. No. 964,454, there is provided as the programming means a set of cam discs associated with switches which actuate the various components of the control means and actuating means, the discs being mounted on a common shaft which is driven in rotation as soon as the initiating means are actuated.

However, such programming means are difficult to arrange and are relatively fragile so that the installation is subject to so many breakdowns that too many technical inspections of the sanitary unit are necessary.

The object of the present invention is to provide stronger programming means, the programming applying not only to one cleaning cycle but to a complete cycle of operation of the sanitary unit.

According to the present invention in the sanitary unit of the aforementioned type said programming means comprise a set of detectors adapted to produce respectively signals each of which represents a given situation of said sanitary unit or a given state of said control means and actuating means, a set of memory means connected so as to store respectively said signals for a given period of said cycle of operation, and relay means connected to said memory means for exciting said control means and actuating means as a function of the selective excitation of said memory means.

According to a particular feature, each memory means determines a particular sequence of said operation of cycle, said sequence being initiated by one of said detectors.

Further features and advantages will be apparent from the ensuing description of a preferred embodiment which is given merely by way of example illustrated by the accompanying drawings in which:

FIG. 1 is a partial top plan view of the sanitary unit illustrating certain control means and actuating means and certain detectors of the sanitary unit;

FIG. 2 is a diagrammatic view illustrating other control means and actuating means and other detectors;

Figure 3A:
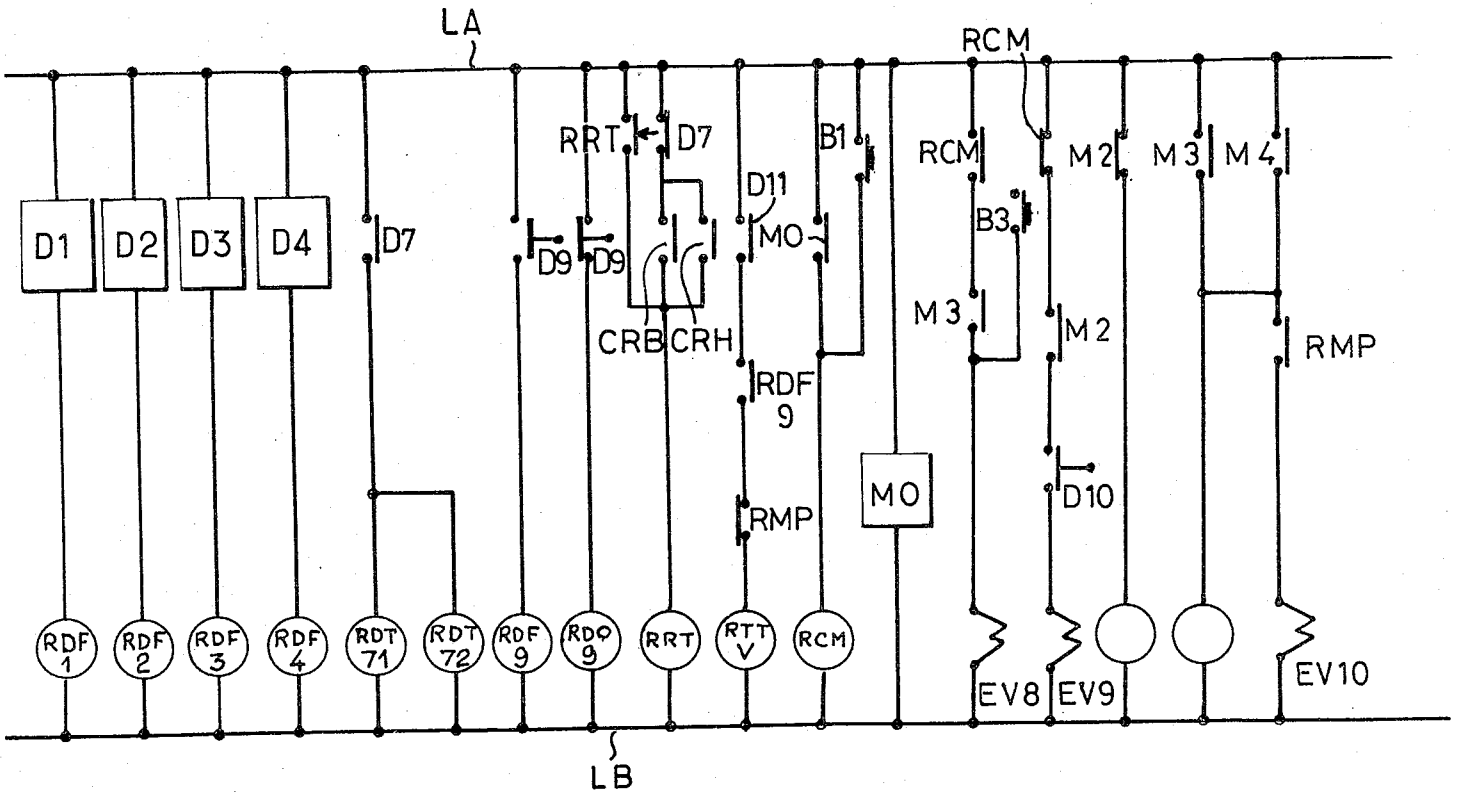
Figure 3B:
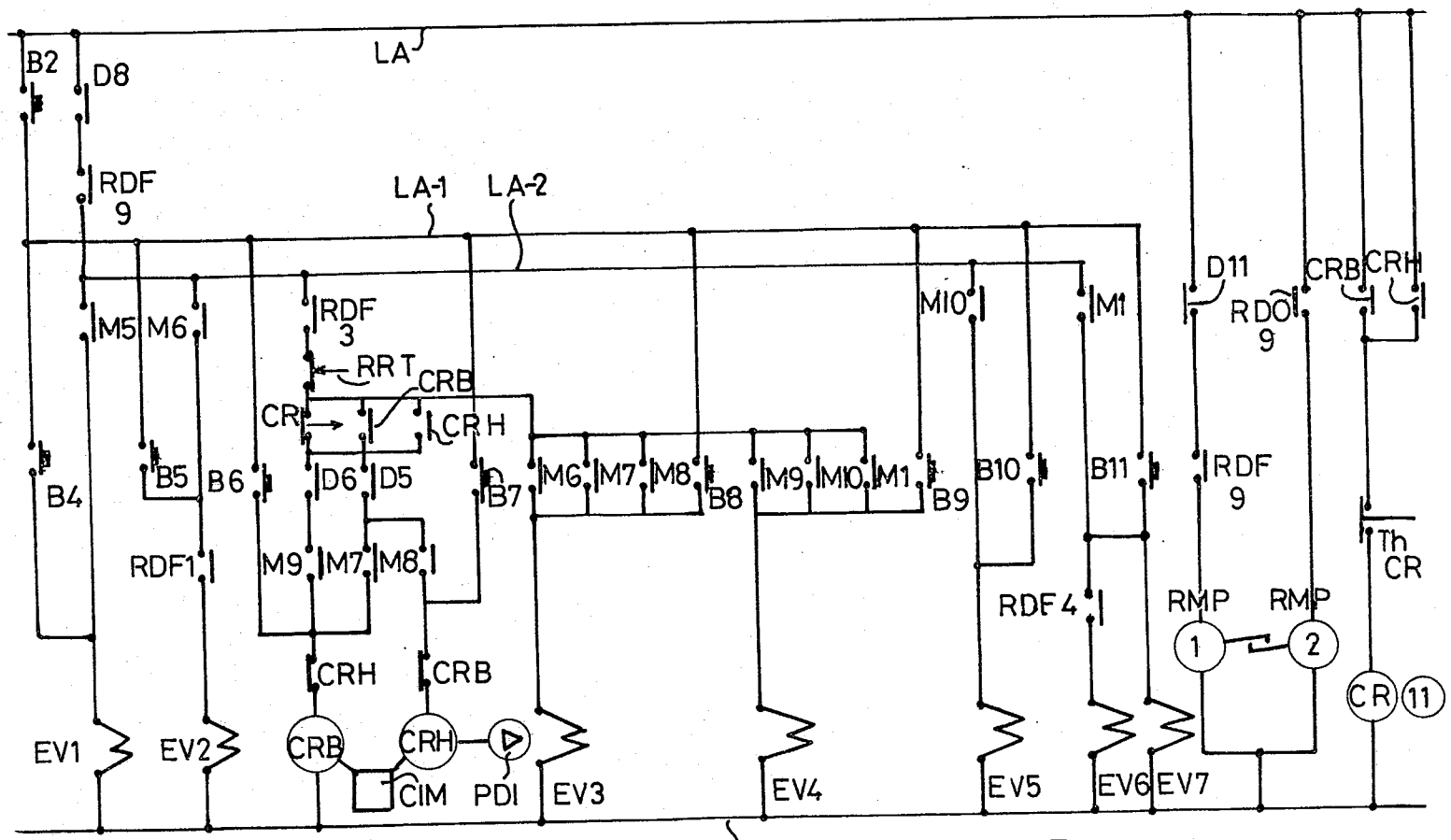
Figure 3C:
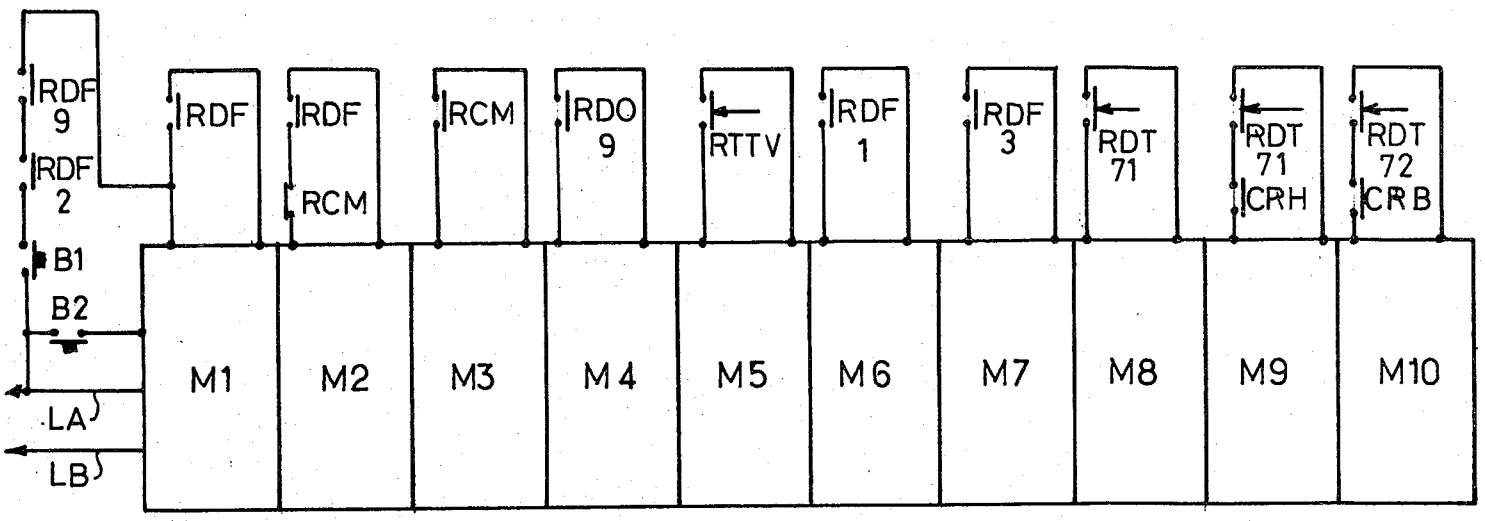
Figure 4A:
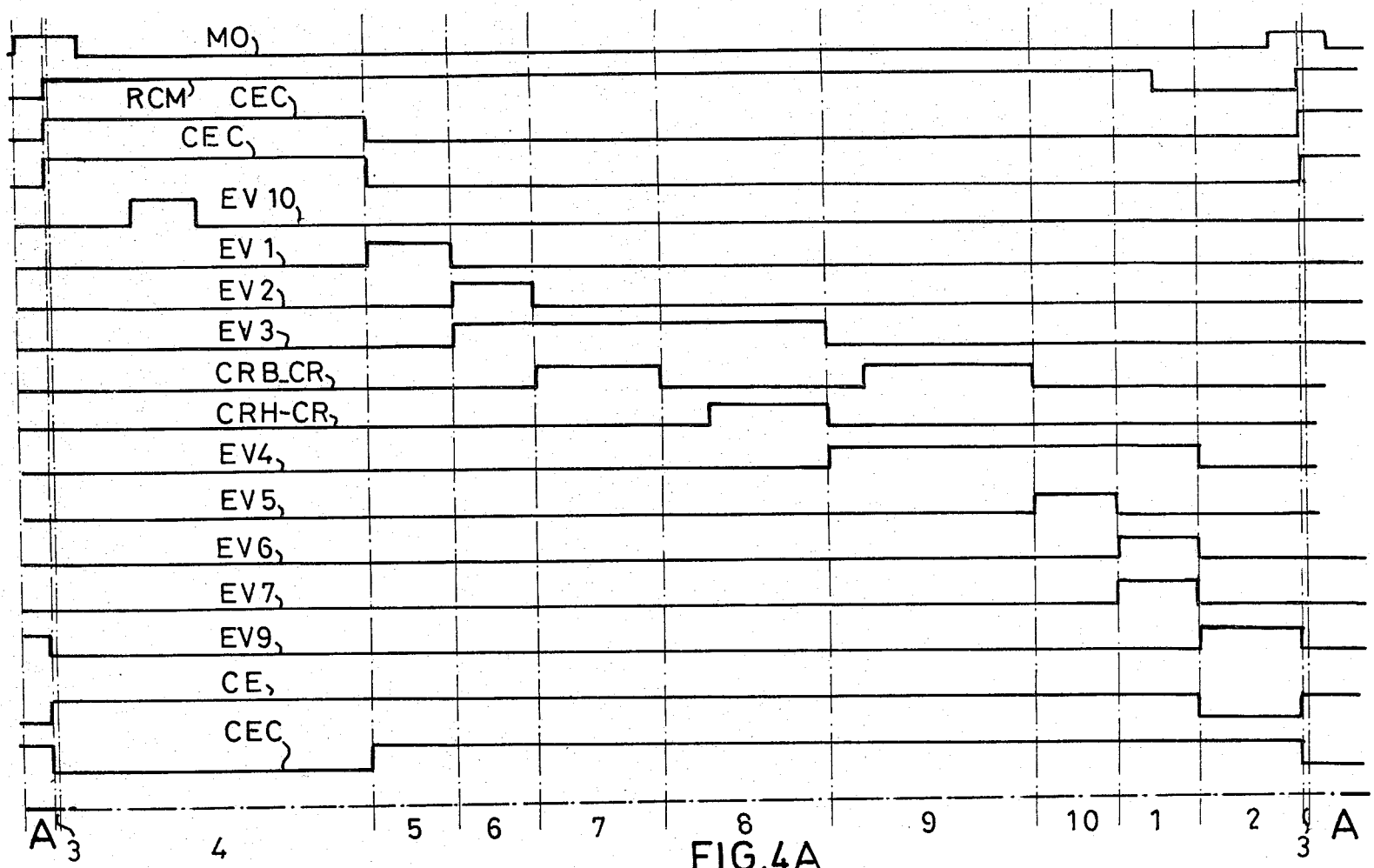
Figure 4B:
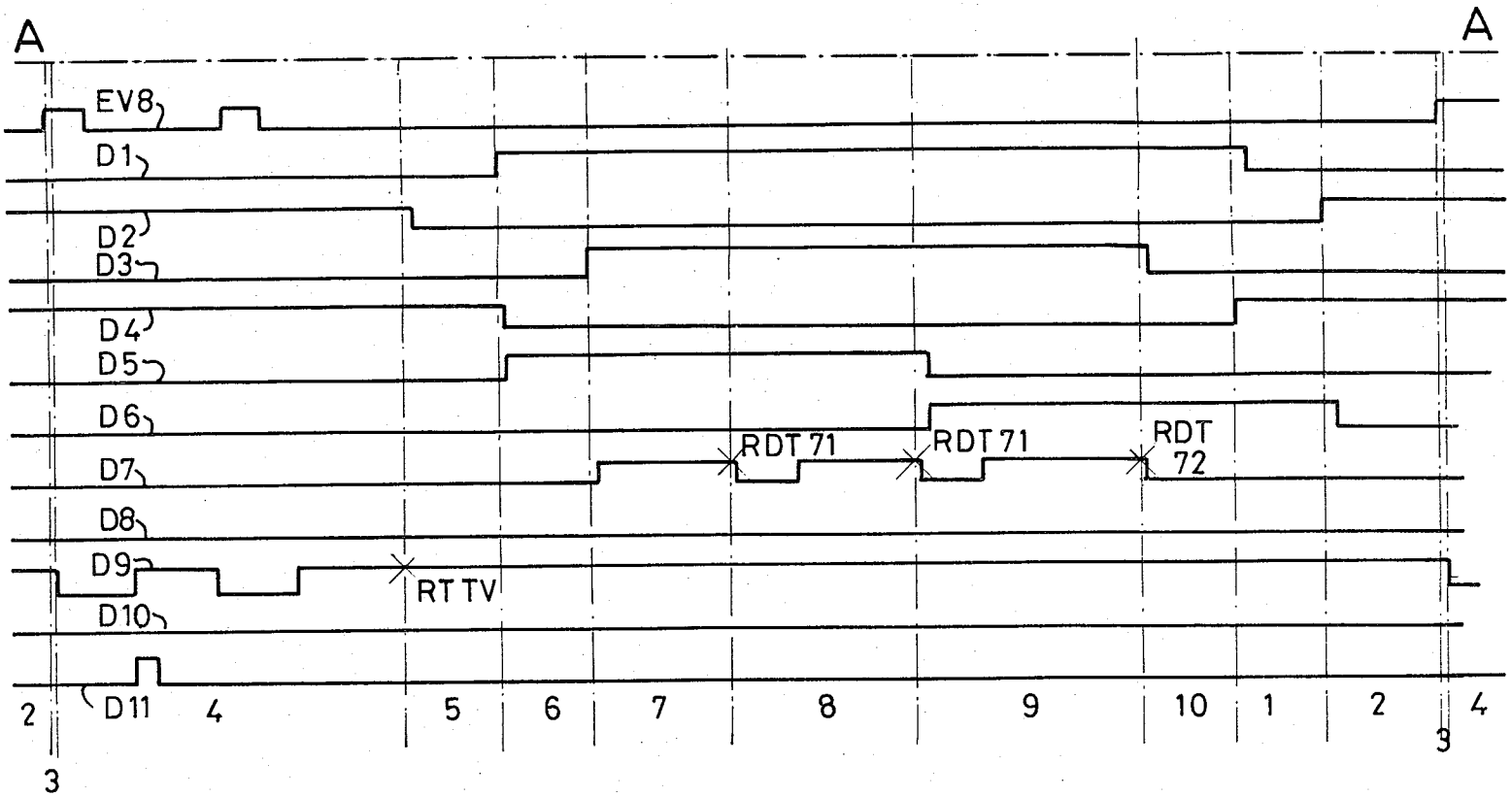
Figure 5:
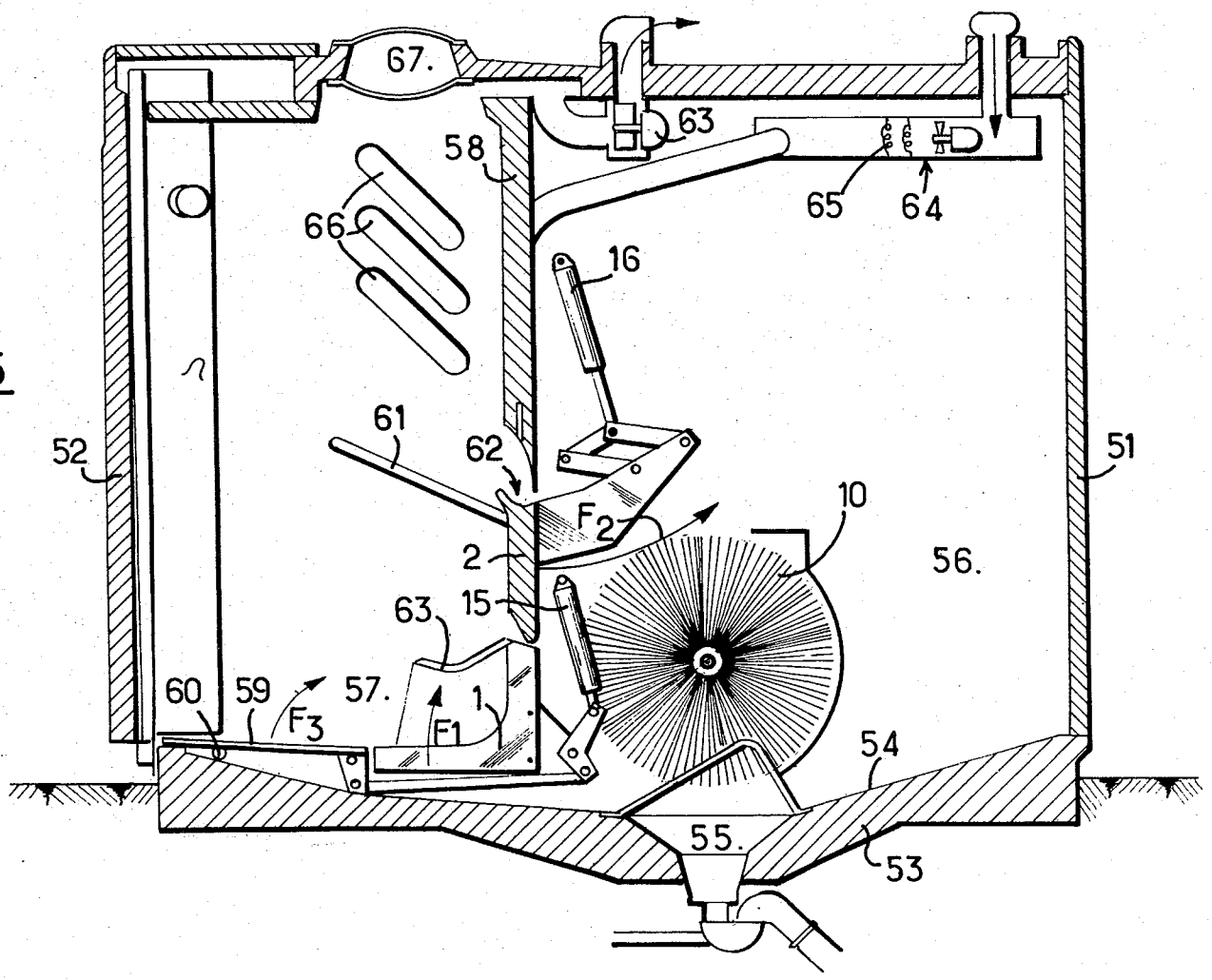
Figure 6:
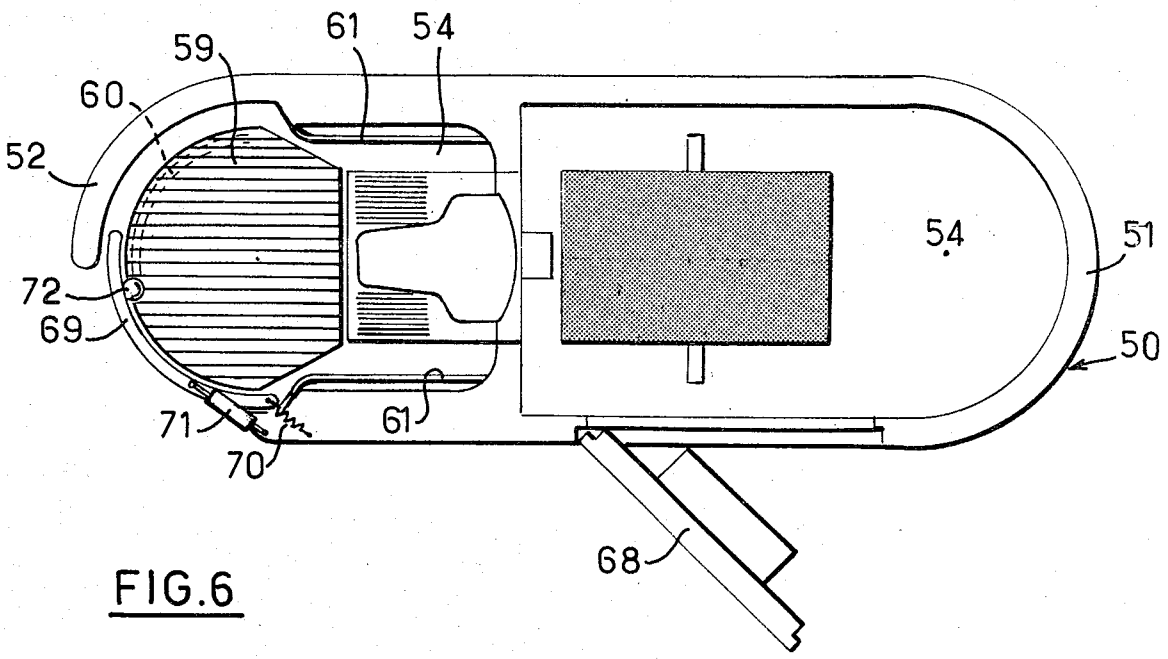

FIGS. 3A, 3B and 3C together form a detailed diagram of the programming and detecting means of the sanitary unit;

FIGS. 4A and 4B are diagrams of the times showing the sequences of operation of the programming means;

FIGS. 5 and 6 are diagrammatic respectively sectional and plan views of another embodiment of the invention.

As in application Ser. No. 964,454, the expression "sanitary unit" encompasses here any installation comprising at least one lavatory, cleaning or washing vessel, for example a lavatory pan, a wash basin or "à la turque" or seatless lavatory pan or an "à l'anglaise" or seat-type lavatory pan. In order to permit an understanding of the particular features of the present addition there will be briefly recalled hereinunder the essential arrangements in the sanitary unit of application Ser. No. 964,454.

Consequently, in the considered embodiment, the sanitary unit comprises a pan 1, extended by an independant back part or element 2, this pan being a lavatory of the so-called "à la turque" or seatless type and being supported by a frame 3. This frame is itself enclosed in a cabin formed by partition walls 5 which are closed in the front by a door 6 provided with a door locking device 7 which is operated by a money-receiving slot machine 8 MO constituting toll means, the rear part of this cabin being closed by a door 9 for the maintenance of the cleaning part located at the rear of the sanitary unit.

The essential feature of application Ser. No. 964,454 resides in the fact that the vessel (which may be formed by a plurality of pans or a plurality of aligned washbasins) is mounted to be movable between a position of use (in which the back part is substantially vertical) and a cleaning position, the last-mentioned position corresponding for example either to a swinging of the vessel to the rear, as occurs in the presentlydescribed embodiment, or to a withdrawal of the vessel, for example downwardly or, to its lateral withdrawal if the cleaning means are located at the side of the sanitary cabin.

In the considered embodiment, the vessel is mounted to be withdrawable by a rearward swinging thereof and the pan 1 is independent of the back part 2. The cleaning means comprise a rotary brush 10 which is also movable between a position of use (FIG. 2) in which the cleaning is operative, and a raised position for reasons which will be explained hereinafter.

As described in detail in application Ser. No. 964,454, this brush is rotatively mounted on a horizontal shaft and is angularly movably mounted on two lateral arms which are pivotally mounted on a shaft, these arms having a angular movement corresponding to the two positions of the brush.

The brush is driven in rotation by a reversible motor-speed reducing unit 11, so as to rotate periodically in one direction and then the other. The brush is disposed in a circular drum which is open at least in its upper part whereas its base part is connected to a spout 12 which is extended by a stench trap 13, the spout and the trap being protected by a grate comprising parallel members oriented in the direction of displacement of the bristles of the rotating brush, these members retaining hard objects which might stop up the trap.

As shown in FIG. 2 the trap is provided with a pipe 14 supplying water under pressure which ejects by the blast effect matter which might have accumulated in the elbow of the trap.

The means for controlling the swinging of the pan and the back part comprises two cylinder devices 15 and 16. It will be observed that, with this arrangement, the pan and the seat swing in two opposite directions as illustrated by the arrows $F_1$ and $F_2$. In the swung over position, the pan 1 faces the rotary brush 10 and the back part 2 closes the upper part of the drum of the brush so as to preclude any projection of water outside the drum. Further, the drum comprises a water supply system 16 provided with radial perforations which extend throughout the generatrix of the brush so as to spray the latter and complete the cleaning. The fluid supplied by the system may be pure water or water to which an antibacteria or anti-microbe desinfecting solution has been added.

The sanitary unit further comprises programming means whereby the movements of the moving parts of the unit and the various safety and locking arrangements of the unit are co-ordinated and programmed.

According to the present invention, these programming means (shown in detail in FIG. 3A to 3C) are of electromagnetic type, for example comprise a number of detectors (11 detectors in the presently described embodiment) and also a plurality of memory means (10 thereof in the presently-described embodiment) which serve to establish as many sequences in the course of the complete cycle of operation of the sanitary unit.

FIGS. 1 and 2 show diagrammatically the location of the detectors which are the following:

$D_1$: back part 2 in the washing position (in dot-dash line).

$D_2$: back part 2 in position in the lavatory (in full line).

$D_3$: pan 1 in the washing position (in dot-dash line).

$D_4$: pan 1 in the operative position in the lavatories (in full line).

$D_5$: indicators of the flow of the washing water from the system 17.

$D_6$: indicators of the flow of water in the trap 13.

$D_7$: indicators of the rotation of the brush.

$D_8$: detectors of the stopping up of the trap 13.

$D_9$: the end-of-travel of the door 6 of the public part (front side of the cabin 4).

$D_{10}$: the end-of-travel of the door 9 of the technical part (actuated by the closed door).

$D_{11}$: detector of the presence of a person in the sanitary unit.

A diagrammatic representation of the detectors $D_1$ to $D_{11}$ is shown in FIGS. 3A to 3C. Some of them are associated, through auxiliary relays, with memory means shown at $M_1$ to $M_{10}$ in FIG. 3C. Thus, for example, the detector $D_1$ is connected in the circuit of a relay $RDF_1$ whereby memory means $M_6$ are excited. In the presently-described embodiment, the memory means $M_1$ to $M_{10}$ are also electromagnetic relays which by means of their respective contacts (carrying the same reference characters in FIGS. 3A to 3C) can bring about the action with which they are associated. For example, the memory means $M_6$, when it is excited, causes through a first of its contacts $M_6$ the excitation of the electric valve $EV_2$ of the disengagement of the pan, i.e. the electric valve which shifts the pan 1 through the cylinder device 18 from the position of use to the washing position.

Through a second of the switches $M_6$ the memory means actuate the electric washing valve $EV_3$ which supplies water to the system 17 placed in front of the rotary brush 10.

Thus it can be seen that each memory excited by a given detector produces the automatic actions with which it is associated. It will be understood that this excitation ceases as soon as the detector concerned no longer detects the phenomenon which originally caused it to react.

There will now be described in detail the relay circuit shown in FIGS. 3A and 3B, after which the operation will be examined with the aid of the time diagram of FIG. 4. However, it must be understood that this circuit only constitutes an example. For example, it is within the capability of those skilled in the art to provide for the described electromagnetic means electronic components having equivalent electric functions.

The relay circuit is supplied with current through supply lines LA and LB between which a DC supply voltage of 24 volts is for example established.

Starting on the left side of FIG. 3A, the following functional relays are employed:

Relay $RDF_1$: excited when the back part 2 is in the raised washing position and put in series with the detector $D_1$.

Relay $RDF_2$: excited by the detect of $D_2$ when the back part 2 is in the position of use inside the lavatories.

Relay $RDF_3$: excited by the detector $D_3$ when the pan 1 is in its washing position.

Relay $RDF_4$: excited by the detector $D_4$ when the pan 1 is in its position of use.

Relays RDT 71 and RDT 72: these relays are excited by the closure of the contact of the detector $D_7$ which is closed so as to detect the rotation of the motor 11 of the brush 17.

Relays $RDF_9$ and $RDO_9$: excited respectively in the closed position and open position of the door 6 by the detector $D_9$ which is associated with the door (respectively working contact and rest contact).

Relay RRT: this relay is connected in series with a circuit of a plurality of contacts respectively associated with the detector $D_7$ (rest contact), with a relay CRB controlling the downward pivoting of the brush and with a relay CRH controlling the upward pivoting of the brush; the relay comprises a self-exciting time contact.

Relay RTTV: this relay is connected in series with a plurality of contacts. It is adapted to establish a delay before the washing operations after a person has left the unit for safety reasons. Thus the relay RTTV is connected in series with a contact of the presence detector $D_{11}$, a closed door relay contact RDF and a contact of a device "storing the presence in the unit", in particular formed by two coils RMP (FIG. 3B).

Relay RCM: excited either by a contact MON, or by a contact DC pertaining to the start of the cycle, the contact MON being associated with the slot maching MO as soon as a coin of money required for using the sanitary unit is inserted in this slot machine.

Electric-valve $EV_8$: this opens the door 6 and is excited by the closure of two contacts in series, one contact $M_3$ of the corresponding memory means and the other of the relay of the slot machine RCM. It may also be manually actuated by a knob $B_3$ for opening the door.

Electromagnet $EV_9$: this ensures the validation of the slot machine MO when a coin of money is inserted therein. It is excited by the connection in series of a resting contact of the relay RCM, a working contact of the memory means $M_2$ and also through the working contact of the detector $D_{10}$.

Relay CE: excited when the memory means $M_2$ is no longer excited (contact $M_2$). It has for function to actuate a device for ventilating the sanitary unit.

Relay CEC: excited through the contacts $M_3$ or $M_4$ of the corresponding memory means. It controls the illumination and heating of the premises.

Electric-valve $EV_{10}$: it controls the washbasin of the sanitary unit and is excited through the contacts $M_3$ or $M_4$ on condition that the relay RMP (FIG. 3B) has been excited (contact RMP).

In the part of the diagram represented in FIG. 3B, it can be seen that the supply line LA is connected to a first auxiliary supply line LA-1 through a manual actuating button $B_2$ and also to a second auxiliary supply line LA-2 through a contact of the detector $D_8$ which detects the stopping up of the trap and a relay contact $RDF_9$. This circuit is a safety measure in that the supply of current to the relays and electric valves in line LA-2 is relatively cut off, on one hand, if the trap 13 is stopped up and, on the other hand, if the door 6 is not closed.

In starting on the left side of FIG. 3B, the following relays and electric valves are employed:

Electric-valve $EV_1$: excited when the memory means $M_5$ are excited or when, for the needs of the maintenance service, a button $B_4$ is actuated. The excitation puts the back part 2 in the washing position.

Electric-valve $EV_2$: excited when the memory means $M_6$ are excited and on condition that the relay $RDF_1$ (FIG. 3A) is excited. It may also be manually excited by means of a button $B_5$.

Relay CRB: it is connected in series with the following contacts $RDF_3$, RRT, CR, $D_6$, $M_9$ and CRM. These contacts may be bypassed by the manual actuating button $B_6$. The contact CR is connected in parallel with two other contacts CRB and CRH and the contacts $D_6$ and $M_9$ are connected in parallel with the contacts $D_5$ and $M_7$. The relay CRB determines the downward movement of the cleaning brush 10 and, for this purpose, it actuates a reversing switch CIM of known type of the motor 11, the latter being supplied with current by the relay CR.

Relay CRH: associated with the relay CRB, this relay CRH is adapted to determine the upward movement of rotation of the motor 11 through the reversing switch CIM. Relay CRH is excited through a contact $M_8$ (relay at the junction between the contacts $D_5$ and $M_7$) and a contact CRB. It may also be manually actuated by the button $B_7$ and moreover actuates a disinfectant pump PDI.

Electric-valve $EV_3$: this may be excited selectively through the contacts $M_6$, $M_7$ or $M_8$, and also by a manual actuating button $B_8$. It ensures the supply of washing water to the system 17.

Electric-valve $EV_4$: excited selectively through the contacts $M_9$, $M_{10}$, or $M_1$ and ensures the supply or rinsing water to the trap 13. A button $B_9$, is provided for manually actuating this electric valve $EV_4$.

Electric-valve $EV_5$: excited by the contact $M_{10}$ and, if desired, manually by a button $B_{10}$. It produces the return of the pan 1 to its position of use.

Electric-valve $EV_6$: excited through the contact $M_1$ and $RDF_4$ and, if desired, by a button $B_{11}$. It causes the back part 2 to return to its initial position.

Electromagnet $EV_7$: excited under the same conditions as the electric valve $EV_6$ for resetting the slot machine MO.

Relays RMP: these relays, which are coils, constitute a memory of the presence of a person in the public part of the sanitary unit. The actuating coil $RMP_1$ is excited through the contacts $RDF_9$ and de-excited through a contact of the detector $D_{11}$. The release coil $RMP_2$ is excited through the contact $RDO_9$.

Relay CR: excited through the contacts of the relays CRB or CRH and connected in series with a safety thermal switch TLCR. This relay causes the motor 11 of the brush 10 to be supplied with current.

It will be observed that the manual actuation of the various means shown in FIG. 3B is achieved through the supply line LA-1 which only carries current when the general button $B_2$ is depressed.

FIG. 3C shows the ten memory means $M_1$ to $M_{10}$ which are relays in the presently described embodiment. They are supplied with current through the lines LA and LB and can be excited respectively through the following contacts: $M_1$-$RDF_4$, $M_2$-$RDF_2$, and RCM (closed), $M_3$-RCM, $M_4$-$RDO_9$, $M_5$-RTTV, $M_6$-$RDF_1$, $M_7$-$RDF_3$, $M_8$-RDT, $M_9$-RDT, and CRH, $M_{10}$-RDT, CRB. Further, the memory means may be manually actuated by a button $B_2$ through the safety contacts $RDF_9$ and $RDF_2$.

This sanitary unit has the following cycle of operations (FIG. 4):

Sequence 1 (see the right side of FIG. 4).

This sequence is initiated at the end of the cleaning so as to return the whole of the sanitary unit to the state in which it may again be used by a person.

The sequence 1 is initiated when the detector $B_4$ detects the return of the pan 1 to the position of use. The relay $RDF_4$ is excited and the memory means $M_1$ are also excited.

This has for effect the validation:

(a) of the operation of the electric valve $EV_4$, which continues to be excited, the action being taken from the memory means $M_{10}$;

(b) the positioning of the back part in the position of use by the electric valve $EV_6$;

(c) the resetting of the slot machine M (which displays "vacant" thereabove) through the contacts $M_1$ and $RDF_4$.

Sequence 2

This sequence is initiated by the excitation of the memory means $M_1$ which are in turn excited through the contacts $RDF_2$ and RCM and the detector $D_2$. Indeed, the storage by the means $M_2$ can only occur when the back part 2 is in its position of use.

This results in the validation:

(a) of the operation of the electromagnet $EV_9$, permitting the insertion of a coin in the slot machine M. This operation is also initiated through the contact RCM (resting contact);

(b) the stoppage of the ventilation of the premises through a switch $M_2$ of the corresponding memory means.

Sequence 3

As soon as the user inserts a coin in the slot machine (which constitutes an operation of detection within the framework of the described programming means), the memory means $M_3$ are excited for storing the signal.

This results in the validation:

(a) of the electric valve $EV_8$ which unlocks the door 6 for the user;

(b) of the relay CEC for turning on the lighting and heating of the premises of the sanitary unit.

Sequence 4

The detector $D_9$ detects the opening of the door 6 and, through the relay $RDO_9$, the memory means $M_4$ is excited. Consequently, the following functions are validated:

(a) the lighting and the heating of the premises (resumption of the operation of sequence 3);

(b) at the same time, by means of the detector $D_{11}$ of a presence in the premises, the excitation of the electric valve $EV_{10}$ for washing the hands (relays $RDF_9$ and $RDO_9$).

During sequence 4, the sanitary unit is in use. The detector $D_9$ therefore detects the opening and then the closing of the door 6. When the latter is closed, the relay $RDF_9$ is excited and actuates the coil $RMP_1$ and, after a certain time, the coil $RMP_2$ which establishes a safety delay which ensures that a person is no longer present in the premises. Moreover, the presence detector $D_{11}$ ensures with a contact of the relay $RDF_9$, the excitation of the coil $RMP_1$.

As the detector $D_{11}$ has detected the absence of a person, the relay $RDF_9$ being excited and the contact RMP being closed, the relay RTTV is excited and thus initiates:

Sequence 5

Indeed, upon excitation of the relay RTTV, the memory means $M_5$ is excited and this validates:

the positioning of the back part 2 for washing by the electric valve $EV_1$;

when the position has been reached, the detector $D_1$ signals the carrying out of the operation and excites the relay $RDF_1$ which initiates:

Sequence 6

The relay RDF actuates the memory means $M_6$ which validates:

(a) the positioning of the pan 1 for washing by the electric valve $EV_2$;

(b) the excitation of the electric valve $EV_3$ of the washing water.

When the pan has reached the washing position, the detector $D_3$ excites the relay $RDF_3$ which initiates:

Sequence 7

The relay $RDF_3$ excites the memory means $M_7$ which validates:

(a) the downward movement of the brush 10 by the relay CRB through the contacts $RDF_3$, RRT, CR, $D_5$, $M_7$ and CRH;

(b) the continuance of the excitation of the washing water electric valve $EV_3$.

As the relay CRB is excited, its contact CRB excites the relay CR which supplies current to the motor. As soon as the rotation of the motor is detected, the detector $D_7$ actuates the relays $RDT_{71}$ and $RDT_{72}$. The relay $RDT_{71}$ initiates, after a certain delay:

Sequence 8

A contact $RDT_{71}$ actuates the memory means $M_8$ which validates:

(a) the upward movement of the brush by the excitation of the relay CRH (contacts RDF, RRT, CRB, $D_5$, $M_8$ and CRB). The relay CR is also excited in order to supply current to the motor 11;

(b) the excitation of the electric valve $EV_3$ which is continued for supplying washing water.

The rotation of the motor 11 is again detected by the detector $D_7$ and, after there has elapsed a delay established by the relay $RDT_{71}$, the memory means $M_9$ is actuated for:

Sequence 9

As the memory means $M_9$ is excited, it validates:

(a) the downward movement of the brush 10 by the relay CRB and the rotation of the motor 11 by the relay CR;

(b) the excitation of the electric valve $EV_4$ supplying water to the trap 13.

In the course of this sequence, it is the relay $RDT_{72}$ which intervenes for initiating:

Sequence 10

The relay $RDT_{72}$, after its time delay, excites the memory means $M_{10}$ which validates:

(a) the positioning of the pan 1 in its initial position of use by the electric valve $EV_5$;

(b) the continuance of the operation of the electric valve $EV_4$, of the trap 13. When the pan 1 has been placed in its position of use, the detector $D_4$ excites the relay $RDF_4$ which again excites the memory means and this places the whole unit in the situation of sequence 1.

Note that some functions may be ensured continuously (night and day) such as for example the heating at a low temperature (for example 8° C.), the extraction of foul air, etc.

As concerns the operation of the brush, the following safety device is preferably provided.

The relay RRT is excited either by the relay CRB or by the relay CRH and when the motor 11 is inoperative (contact of detector $D_7$) this initiates a time delay in the relay RRT so as to cut off in the circuit of the relays CRB and CRH, at the end of a period of 100 to 150 seconds, the motor 11 itself and the electric valves $EV_3$, $EV_4$. In other words, this safety measure operates if, within said period, the detector $D_7$ has not detected the displacement of the brush 10.

Further, owing to a time contact CR in the circuit of the relays CRB and CRH, this circuit can only be closed if the brush has stopped for a given period of time, which may be, for example, 3 seconds. Moreover, the brush can only rotate:

(1) if the washing water flows during the sequences 7 and 8 (detector $D_5$) or if the water flows in the trap 13 during the sequence 9 (detector $D_6$);

(2) if, with the relay CRB or CRH excited, no displacement is detected by the speed detector $D_7$. This might happen, for example, when a belt breaks between the motor and the brush or if the motor thermal circuit breaker operates (TLCR).

In the case of break-down, the motor 11 and the washing water supply are consequently stopped until a person in charge of maintenance arrives.

It will be understood, as already described, that each operation may be manually controlled by means of the buttons $B_1$ to $B_{11}$. All the operations may be if desired signalled by indicators.

There may also be provided a counting device (not shown) which adds up all the cycles effected during a given period.

The foregoing description shows that the sanitary unit according to the invention operates fully automatically and comprises devices for ensuring perfect safety of persons while guaranteeing perfect cleanliness of the premises.

FIGS. 5 and 6 show another embodiment of the sanitary unit according to the invention.

The unit comprises a cabin 50 which has a substantially rectangular shape in plan although its small sides 51 and 52 are radiused. This cabin is mounted on a preferably concrete base 53 and its upper surface which constitutes the bottom 54 of the cabin, has a double slope in order to facilitate the flow of water through a stench trap 55.

The cabin 50 is divided into two compartments, namely a compartment 56 for the user and a compartment 57 pertaining to the technical premises, these compartments being separated by a partition wall 58.

The mechanisms and controls for the cleaning of the pan 1 and the backpart 2 are identical to those already described with reference to FIGS. 1 to 4, it being understood that the pan 1 is here formed by a seat of the so-called "á l'anglaise" type. Further, the following differences and/or additions may be mentioned.

The cylinder device 15 which is adapted to swing the seat 1 is also coupled to a grating or like floor element 59 which extends in front of the seat 1 and is raisable in the direction of arrow $F_3$ when the cylinder device 15 is actuated. Placed under this grating is a spray system 60 which follows along the curvature of the small side of the cabin and is adapted to spray the bottom 54 of the base 53 when the cleaning procedure described hereinbefore takes place. The grating 59 may be associated with a detector (not shown) which is actuated by the weight of a person when this person enters the cabin, this detector then acting as a presence detector as described hereinbefore.

Also provided in the compartment 57 on each side of the seat 1 are handles 61 which also preferably form water spray system which spray the compartment in question in the course of the cleaning procedure.

Consequently, during this procedure, the whole of the compartment 57 may be cleaned at the same time as the seat 1 and the backpart 2, the washing water being sprayed by the systems 60 and 61 just described. The cleaning water flows to the trap 55 owing to the slope of the bottom 54.

In order to ensure the drying of this assembly, hot air streams may be provided, which pass under the partition wall and come from the technical compartment.

A hand washing means 62 are provided, here in the partition wall 58, the wash basin of these means being provided in the upper part of the back part 2.

The seat 1 is also provided with two heating elements 63 which are disposed on each side thereof and adapted to accelerate the drying of the seat after cleaning operations. These elements are preferably in a form of pipes which are incorporated within the seat itself and have hot air which comes from the technical department and passes there through.

In the same way as the cabin described with reference to FIGS. 1 to 4, the cabin of FIGS. 5 and 6 comprises an extracting fan 63, an aeration fan 64 with its heating element 65, portholes 66 and a light 67.

The technical compartment 56 is closed by a side door 68 and the compartment 67 for the user is closed by a radiused door 69 which is biased to its closed position by a return mechanism 70 symbolically represented by a spring in FIG. 6.

This door is also provided with an opening and closing cylinder device 71, shown diagrammatically, and an inner handle 72. This cylinder device is actuated following on the insertion of a coin in the slot machine (sequence 3 described hereinbefore) after which the door is slightly opened and released so as to be completely opened by the user in opposition to the action of the return mechanism 70. Thus this door automatically closes behind the person. Likewise, in order to leave the sanitary unit, the person actuates the handle 72 which again actuates the cylinder device 71 so as to release the door, after which the person can leave the unit and allow the door to close under the action of the return mechanism 70. The cylinder device 71 then relocks the door (see sequence 4 described hereinbefore).

I claim:

1. A sanitary unit comprising a vessel mounted to be movable between a first position of use and a second position for cleaning, cleaning means for bringing into action when the vessel is in said second position, a pipe for discharging dirty water and dejections, control means for controlling the displacement of the vessel between said first position and said second position, actuating means for actuating the cleaning means, programming means for co-ordinating the actions of said control means and said actuating means in the course of each cycle of operation of the sanitary unit, and initiating means which initiate a cleaning cycle associated with said programming means, said programming means comprising a set of detectors for respectively generating signals respectively representing given situations of said sanitary unit and given states of said control means and actuating means, a set of memory means connected for respectively storing said signals during a given period of said cycle of operation and relay means connected to said memory means for exciting said control means and actuating means as a function of a selective excitation of said memory means.

2. A sanitary unit as claimed in claim 1, wherein each memory means determines a particular sequence of said cycle of operation, said sequence being initiated by a respective one of said detectors.

3. A sanitary unit as claimed in claim 1, comprising at least one relay interconnected between each detector and the associated memory means.

4. A sanitary unit as claimed in claim 3, wherein the vessel comprises a lavatory pan and a separate back element each of which are angularly movable between a position of use and a cleaning position, said control means being associated with the pan and with the back element for moving the pan and the back element between a first position of use and a second position for cleaning, the pan and the back element moving in opposite directions, the sanitary unit comprising a detector for each of said positions of the pan and of the back element and relay means for establishing an appropriate succession of movements of said back element and said pan.

5. A sanitary unit as claimed in claim 1, 2, 3 or 4, wherein said programming means further comprise safety means for allowing operation of the cleaning means only after a certain delay after the moment when a user leaves the sanitary unit.

6. A sanitary unit as claimed in claim 5, comprising a compartment for the user of the sanitary unit, a door for opening and closing said compartment, and a detector for detecting the closure of said door and associated with said safety means for initiating said delay.

7. A sanitary unit as claimed in claim 1, 2, 3 or 4, wherein said cleaning means comprise a brush which is mounted to rotate about a horizontal axis and is movable between an upper position and a lower position, and an electric motor drivingly connected to the brush, the sanitary unit comprising a detector which detects the return of the vessel to said cleaning position thereof and is associated with the brush to initiate the kinematics of the brush when the vessel returns to said cleaning position thereof, said motor being capable of driving the brush in either direction of rotation, relays for controlling the kinematics of the brush for each movement of the brush and a timing circuit for actuating the last mentioned relays in predetermined operational periods of the motor for both directions of movement of the brush.

8. A sanitary unit as claimed in claim 7, wherein the relays controlling the kinematics of said brush are governed by safety means which detect the rotation of the brush, said safety means being capable of precluding given functions of said cleaning means, such as the supply of washing water, by means of a timing circuit.

9. A sanitary unit as claimed in claim 1, 2, 3 or 4, wherein said programming means comprise toll means which are capable of governing the performance of a cycle of operation by a payment.

10. A sanitary unit as claimed in claim 1, 2, 3 or 4, comprising manual control means for manually carrying out at least the essential operations of the sanitary unit for servicing and checking purposes.

11. A sanitary unit as claimed in claim 1, 2, 3 or 4, further comprising a grating which is mounted to be movable between a position of use and a raised cleaning position is mechanically connected to said vessel and is placed in front of the latter so as to act as a floor.

12. A sanitary unit as claimed in claim 11, comprising in association which said grating a detector which is positioned to be actuated when a person is placed on said grating so as to signal the presence of said person in the sanitary unit.

13. A sanitary unit as claimed in claim 1, 2, 3 or 4, comprising a compartment for receiving the user, water spraying systems in the compartment and means for actuating said systems in the course of the cleaning of said vessel.

14. A sanitary unit as claimed in the claim 13, wherein at least one of said spraying systems is a handle placed alongside of side of said compartment.

15. A sanitary unit as claimed in claim 1, 2, 3 or 4, comprising heating means directly incorporated within said vessel so as to accelerate the drying after the cleaning thereof.

16. A sanitary unit as claimed in claim 1, 2, 3 or 4, comprising a compartment for receiving the user, a door for opening and closing said compartment, return means which are associated with the door to bias the door to its closing position, door locking means associated with the door, toll means located outside the unit and a handle placed inside the unit for unlocking the door locking means and allowing the opening of the door.

* * * * *